US011398708B2

(12) United States Patent
Li et al.

(10) Patent No.: US 11,398,708 B2
(45) Date of Patent: Jul. 26, 2022

(54) CONVERTER

(71) Applicant: GONGNIU GROUP CO., LTD., Zhejiang (CN)

(72) Inventors: Zhen Li, Zhejiang (CN); Fuyu Li, Zhejiang (CN); Han Cheng, Zhejiang (CN); Jinbiao Jiang, Zhejiang (CN)

(73) Assignee: GONGNIU GROUP CO., LTD., Zhejiang (CN)

( * ) Notice: Subject to any disclaimer, the term of this patent is extended or adjusted under 35 U.S.C. 154(b) by 0 days.

(21) Appl. No.: 17/285,330

(22) PCT Filed: May 29, 2020

(86) PCT No.: PCT/CN2020/093476
§ 371 (c)(1),
(2) Date: Apr. 14, 2021

(87) PCT Pub. No.: WO2020/239106
PCT Pub. Date: Dec. 3, 2020

(65) Prior Publication Data

US 2021/0384685 A1 Dec. 9, 2021

(30) Foreign Application Priority Data

May 30, 2019 (CN) ..... 201910463658.9

(51) Int. Cl.
*H01R 31/06* (2006.01)
*H01R 27/00* (2006.01)
(Continued)

(52) U.S. Cl.
CPC ..... *H01R 31/06* (2013.01); *H01R 27/00* (2013.01); *H01R 2103/00* (2013.01); *H01R 2105/00* (2013.01)

(58) Field of Classification Search
CPC H01R 2103/00; H01R 2105/00; H01R 27/00; H01R 13/60
See application file for complete search history.

(56) References Cited

U.S. PATENT DOCUMENTS 4,626,052 A 12/1986 Rumble
5,641,292 A * 6/1997 Fann ..... H01R 24/30 439/103
(Continued)

FOREIGN PATENT DOCUMENTS

CN 105206993 A 12/2015
CN 105261907 A 1/2016
(Continued)

OTHER PUBLICATIONS

International Search Report and Written Opinion issued in corresponding International Application No. PCT/CN2020/093476 dated Sep. 3, 2020, with English translation.
(Continued)

*Primary Examiner* — Briggitte R. Hammond
(74) *Attorney, Agent, or Firm* — Morgan, Lewis & Bockius LLP

(57) ABSTRACT

The present disclosure provides a converter, including a housing and a three-pole plug pin assembly. The three-pole plug pin assembly includes a toggle button assembly, and the toggle button assembly is configured to be able to move between a first position and a second position. When the toggle button assembly is at the first position, the toggle button assembly is capable of driving an L-pole plug pin, an N-pole plug pin and an earth-pole plug pin to extend out of the housing. When the toggle button assembly is at the second position, the earth-pole plug pin is capable of being received in the housing under an action of a first elastic member.

18 Claims, 7 Drawing Sheets

(51) Int. Cl.
*H01R 103/00* (2006.01)
*H01R 105/00* (2006.01)

(56) References Cited

U.S. PATENT DOCUMENTS

| | | | | |
|---|---|---|---|---|
| 6,053,750 | A * | 4/2000 | Waible | H01R 13/506 439/106 |
| 6,780,033 | B2 | 8/2004 | Liu | |
| 8,297,994 | B2 * | 10/2012 | Lee | H01R 29/00 439/172 |
| 9,083,125 | B2 * | 7/2015 | Rogers | H01R 27/00 |
| 11,005,214 | B2 * | 5/2021 | Edwards | H01R 13/20 |
| 2018/0337501 | A1 | 11/2018 | Cai et al. | |
| 2019/0312395 | A1 | 10/2019 | Barnett et al. | |

FOREIGN PATENT DOCUMENTS

| | | | |
|---|---|---|---|
| CN | 207217954 | U | 4/2018 |
| CN | 110098545 | A | 8/2019 |
| CN | 209981671 | U | 1/2020 |
| JP | 60-258879 | A | 12/1985 |
| JP | 2019-501506 | A | 1/2019 |

OTHER PUBLICATIONS

Office Action (Decision to Grant) issued in corresponding Japanese Patent Application No. 2021-519562 dated Jan. 25, 2022, with English translation.

* cited by examiner

CONVERTER

CROSS-REFERENCE TO RELATED APPLICATIONS

This application is a national phase entry under 35 USC 371 of International Patent Application No. PCT/CN 2020/093476 filed on May 29, 2020, which claims priority to Chinese Patent Application No. 201910463658.9, filed on May 30, 2019, which are incorporated herein by reference in their entirety.

TECHNICAL FIELD

The present disclosure relates to a converter.

BACKGROUND

A converter is a device that converts a form of socket into another one or more forms of sockets.

Standards of power plugs in various countries in the world are different. For example, three-pole plugs in China are the same as three-pole plugs in Australia, but two-pole plugs in China are different from two-pole plugs in Australia. The two-pin plugs in China are the same as two-pin plugs in the United States, but the three-pin plugs in China are different from three-pin plugs in the United States. Thus, conversions are generally required between sockets in a plurality of different countries and an international standard socket, so as to be able to use Chinese plugs. Therefore, a converter is needed.

For example, an European standard socket is converted into the international standard socket, and an American standard socket is converted into the international standard socket, so as to provide power supply for an electrical appliance with an international standard plug such as a mobile phone charger with the international standard plug and a notebook power supply with the international standard plug through the converter on the European standard socket and the American standard socket.

SUMMARY

Some embodiments of the present disclosure provide a converter. The converter includes a housing and a three-pole plug pin assembly. The three-pole plug pin assembly includes: a body disposed in the housing, the body being configured to be able to move relative to the housing, and the body including a cavity and a through hole communicated with the cavity; an L-pole plug pin and an N-pole plug pin that are fixed on the body, the body being capable of driving the L-pole plug pin and the N-pole plug pin to extend out of or retract into the housing when moving relative to the housing; an earth-pole plug pin separated from the body, the earth-pole plug pin passing through the through hole of the body; a first elastic member connected to the earth-pole plug pin and disposed in the housing; and a toggle button assembly connected to the body, the toggle button assembly being located in the cavity of the body, and the toggle button assembly being configured to be able to move relative to the body between a first position and a second position in the cavity. When the toggle button assembly is at the first position, the toggle button assembly is connected to the earth-pole plug pin, so that the toggle button assembly is capable of driving the earth-pole plug pin, the L-pole plug pin and the N-pole plug pin to extend out of the housing. When the toggle button assembly is at the second position, the toggle button assembly is separated from the earth-pole plug pin, so that the earth-pole plug pin is received in the housing under an action of the first elastic member.

In some embodiments, the toggle button assembly is configured to be clamped with the earth-pole plug pin at the first position, so as to be connected to the earth-pole plug pin.

In some embodiments, the toggle button assembly includes a toggle button and a lock pin. The toggle button includes a bracket and a mounting hole located in the bracket. The mounting hole is communicated with the through hole of the body, and the lock pin is located in the mounting hole, and the earth-pole plug pin passes through the mounting hole. The earth-pole plug pin includes a clamping groove located in a side face of the earth-pole plug pin. The lock pin is configured such that: when the toggle button assembly is at the first position, the lock pin extends into the clamping groove, so that the toggle button assembly is clamped with the earth-pole plug pin; and when the toggle button assembly is at the second position, the lock pin is separated from the clamping groove.

In some embodiments, the lock pin includes a lock pin body and a second elastic member. A first end of the second elastic member is connected to an inner wall of the bracket, and a second end of the second elastic member is connected to the lock pin body. The second elastic member is configured to apply an elastic force to the lock pin body, which enables the lock pin body to move towards the earth-pole plug pin.

In some embodiments, the lock pin further includes a first limiting portion, and the first limiting portion is located on an end of the lock pin body proximate to the second elastic member. The toggle button further includes a second limiting portion, and the second limiting portion is located at a side of the first limiting portion proximate to the earth-pole plug pin. The second limiting portion is capable of abutting against the first limiting portion, so as to prevent the lock pin body from moving towards the earth-pole plug pin.

In some embodiments, in a depth direction of the clamping groove, a dimension of the earth-pole plug pin is less than a dimension of the mounting hole, so that the lock pin body is capable of moving relative to the earth-pole plug pin.

In some embodiments, the housing includes a first sliding groove and a second sliding groove that are communicated with each other. The first sliding groove extends in a direction in which the earth-pole plug pin extends out of the housing, and the second sliding groove extends in a direction perpendicular to an extending direction of the first sliding groove. The toggle button further includes a hand-held portion, and the hand-held portion is fixedly connected to the bracket. The hand-held portion extends out of the housing, and the hand-held portion is capable of sliding along both the first sliding groove and the second sliding groove. The second sliding groove is configured such that: when the hand-held portion slides along the second sliding groove, the toggle button assembly moves relative to the body between the first position and the second position.

In some embodiments, the housing has a first side wall, and the first side wall is arranged opposite to the body. The housing includes a first blocking portion and a second blocking portion that are located on an inner surface of the first side wall. The first blocking portion is spaced apart from the second blocking portion in a direction in which the earth-pole plug pin extends out of the housing. The first blocking portion is configured to be able to abut against a side surface of the bracket proximate to the second blocking portion in a case where the L-pole plug pin, the N-pole plug pin and the earth-pole plug pin are received in the housing, so as to prevent the bracket from moving towards the second blocking portion. The second blocking portion is configured to be able to abut against a side surface of the bracket proximate to the first blocking portion in a case where the L-pole plug pin and the N-pole plug pin extend out of the housing, so as to prevent the bracket from moving towards the first blocking portion.

In some embodiments, the housing includes a boss located on the inner surface of the first side wall. The boss has a first end face and a second end face in the direction in which the earth-pole plug pin extends out of the housing. The first end face forms the first blocking portion, and the second end face forms the second blocking portion.

In some embodiments, the housing has a first side wall, and the first side wall is arranged opposite to the body. The three-pole plug pin assembly further includes a third elastic member. A first end of the third elastic member is connected to an inner wall of the body, and a second end of the third elastic member is connected to the bracket. The third elastic member is configured to apply an elastic force to the bracket, which enables the bracket to move towards the first side wall, so that the bracket is able to abut against the first side wall.

In some embodiments, an elastic coefficient of the third elastic member is greater than an elastic coefficient of the first elastic member.

In some embodiments, the through hole of the body includes a first through hole and a second through hole. The first through hole is spaced apart from the second through hole in a direction in which the earth-pole plug pin extends out of the housing.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on an actual size of a product, an actual process of a method and an actual timing of a signal to which the embodiments of the present disclosure relate.

DETAILED DESCRIPTION

Figure 1:
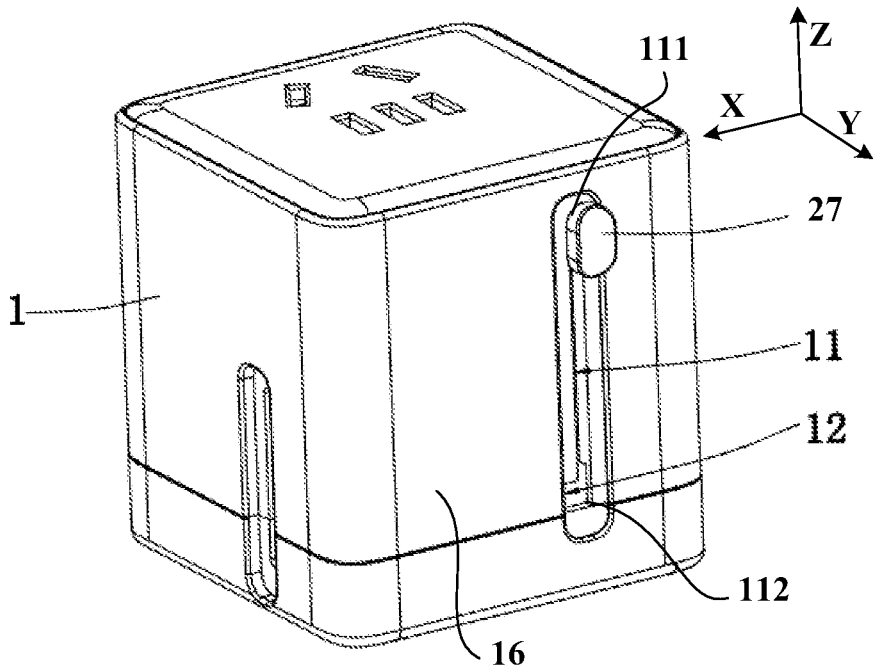
FIG. 1 is a perspective view of a converter in accordance with some embodiments of the present disclosure.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art on a basis of the embodiments of the present disclosure shall be included in the protection scope of the present disclosure.

Unless the context requires otherwise, the term "comprise" and other forms thereof such as the third-person singular form "comprises" and the present participle form "comprising" throughout the description and the claims are construed as an open and inclusive meaning, i.e., "including, but not limited to".

In the description of the specification, terms such as "one embodiment", "some embodiments", "exemplary embodiments", "an example", "specific example", or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Terms such as "first" and "second" are only used for descriptive purposes, and are not to be construed as indicating or implying the relative importance or implicitly indicating the number of indicated technical features below. Thus, a feature defined by "first" or "second" may explicitly or implicitly include one or more of the features. In the description of the embodiments of the present disclosure, the term "a plurality of/the plurality of" means two or more unless otherwise specified.

In the description of some embodiments, terms such as "coupled" and "connected" and their extensions may be used. For example, the term "connected" may be used in the description of some embodiments to indicate that two or more components are in direct physical or electrical contact with each other.

The phrase "at least one of A, B and C" has the same meaning as the phrase "at least one of A, B or C", and both include the following combinations of A, B and C: only A, only B, only C, a combination of A and B, a combination of A and C, a combination of B and C, and a combination of A, B and C.

The phrase "A and/or B" includes the following three combinations: only A, only B, and a combination of A and B.

The use of the phrase "applicable to" or "configured to" herein means an open and inclusive expression, which does not exclude devices that are applicable to or configured to perform additional tasks or steps.

Exemplary embodiments are described herein with reference to sectional views and/or perspective views as idealized exemplary drawings.

A three-pole plug pin assembly of a converter generally needs to be used with and without an earth-pole plug pin. In a case where the three-pole plug pin assembly is used with the earth-pole plug pin, the three-pole plug pin assembly is a three-pole plug, and in this case, the converter may be used as a three-pole socket. In a case where the three-pole plug pin assembly is used without the earth-pole plug pin, the three-pole plug pin assembly is a two-pole plug, and in this case, the converter may be used as a two-pole socket. In the related art, the earth-pole plug pin of the converter is generally hidden in a folding manner, and in a case where the converter is used as the two-pole socket, a user needs to rotate the earth-pole plug pin of the converter by a certain angle and fold it to be hidden in a housing of the converter. However, an operation of hiding the earth-pole plug pin is cumbersome, and it is inconvenient to operate when the converter is converted from the three-pole socket to the two-pole socket, and thus it is inconvenient for the user to use the converter.

Figure 2:
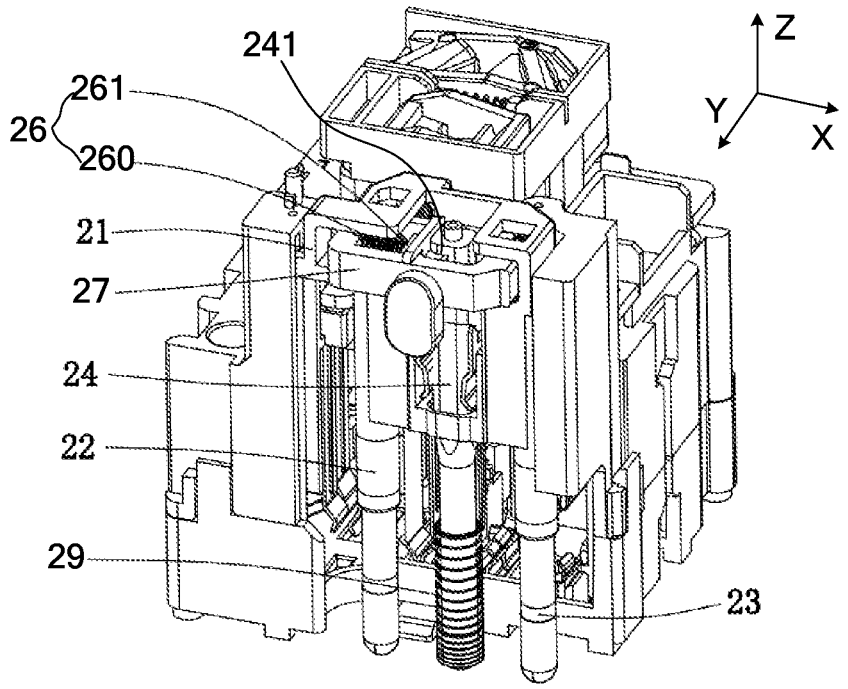
FIG. 2 is a perspective view of a partial structure of a converter in accordance with some embodiments of the present disclosure.
Figure 5:
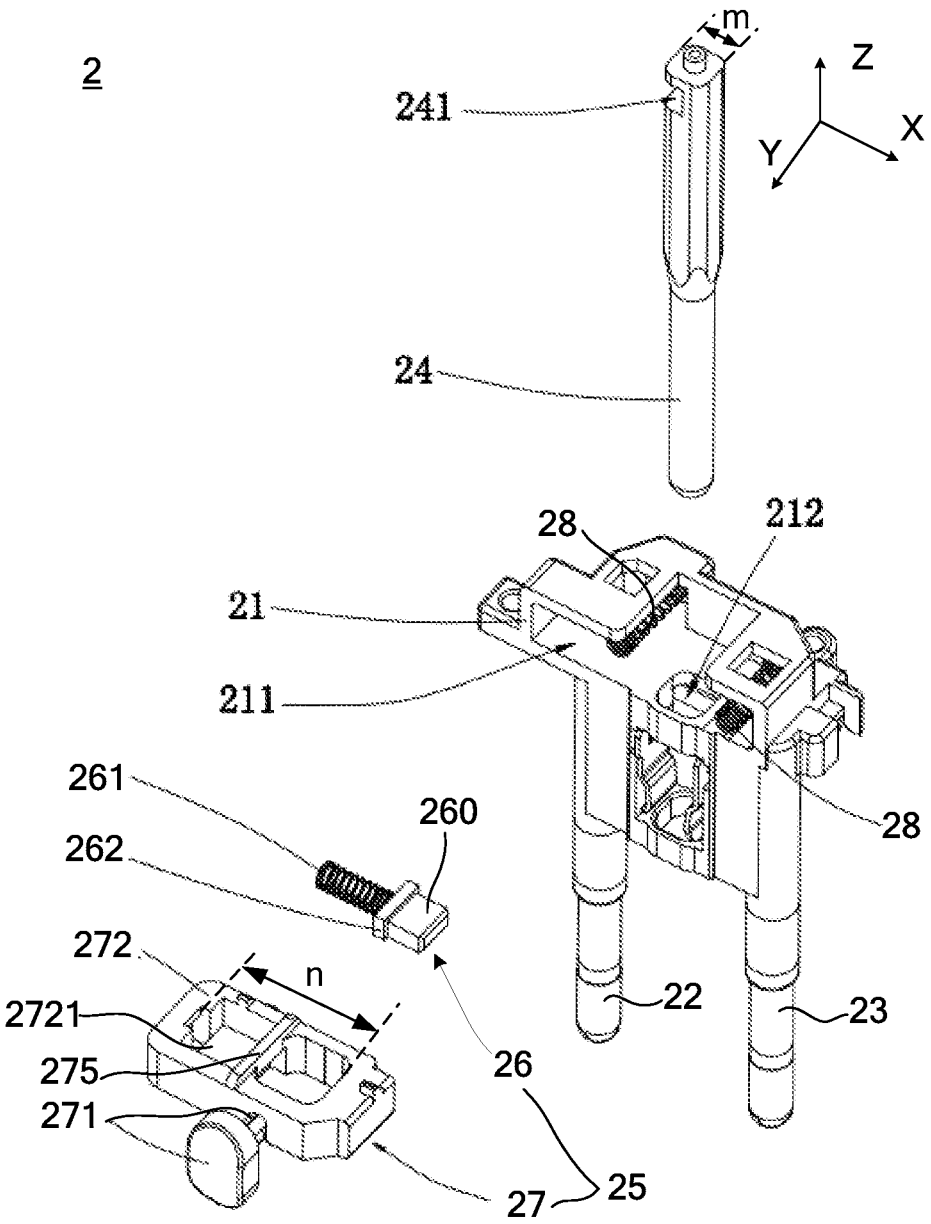
FIG. 5 is an exploded perspective view of a three-pole plug pin assembly of a converter in accordance with some embodiments of the present disclosure.

As shown in FIGS. 1 and 2, some embodiments of the present disclosure provide a converter. The converter includes a housing 1 and a three-pole plug pin assembly 2. As shown in FIG. 5, the three-pole plug pin assembly 2 includes a body 21 disposed in the housing 1, a live-pole (L-pole) plug pin 22 and a neutral-pole (N-pole) plug pin 23 that are fixed on the body 21, an earth-pole plug pin 24 separated from the body 21, and a toggle button assembly 25 movably connected to the body 21. The body 21 is configured to be able to move relative to the housing 1 in a Z direction.

As shown in FIG. 5, in some embodiments, the body 21 includes a cavity 211, a first through hole 212 and a second through hole 213. FIG. 5 illustrates an XYZ coordinate system in which the X direction is the same as an arrangement direction of the L-pole plug pin 22 and the N-pole plug pin 23, and the Z direction is the same as an extending direction of the earth-pole plug pin 24. The X direction, the Y direction and the Z direction are perpendicular to each other. XYZ coordinate systems shown in other drawings are the same as the XYZ coordinate system shown in FIG. 5. In the Z direction shown in FIG. 5, the cavity 211 is communicated with the first through hole 212, and the first through hole 212 and the second through hole 213 are arranged opposite to each other. In the X direction shown in FIG. 5, the L-pole plug pin 22 is located at a side of the first through hole 212 and the second through hole 213, and the N-pole plug pin 23 is located at another side, opposite to the side, of the first through hole 212 and the second through hole 213.

As shown in FIG. 5, in some embodiments, the toggle button assembly 25 includes a toggle button 27 and a lock pin 26. The toggle button 27 includes a bracket 272 and a hand-held portion 271 fixed on the bracket 272. The bracket 272 includes a mounting hole 2721, and the mounting hole 2721 may be a through hole. As shown in FIG. 5, through holes on both sides of a second limiting portion 275 are communicated in the X direction, and the two through holes form the mounting hole 2721 together.

Figure 3:
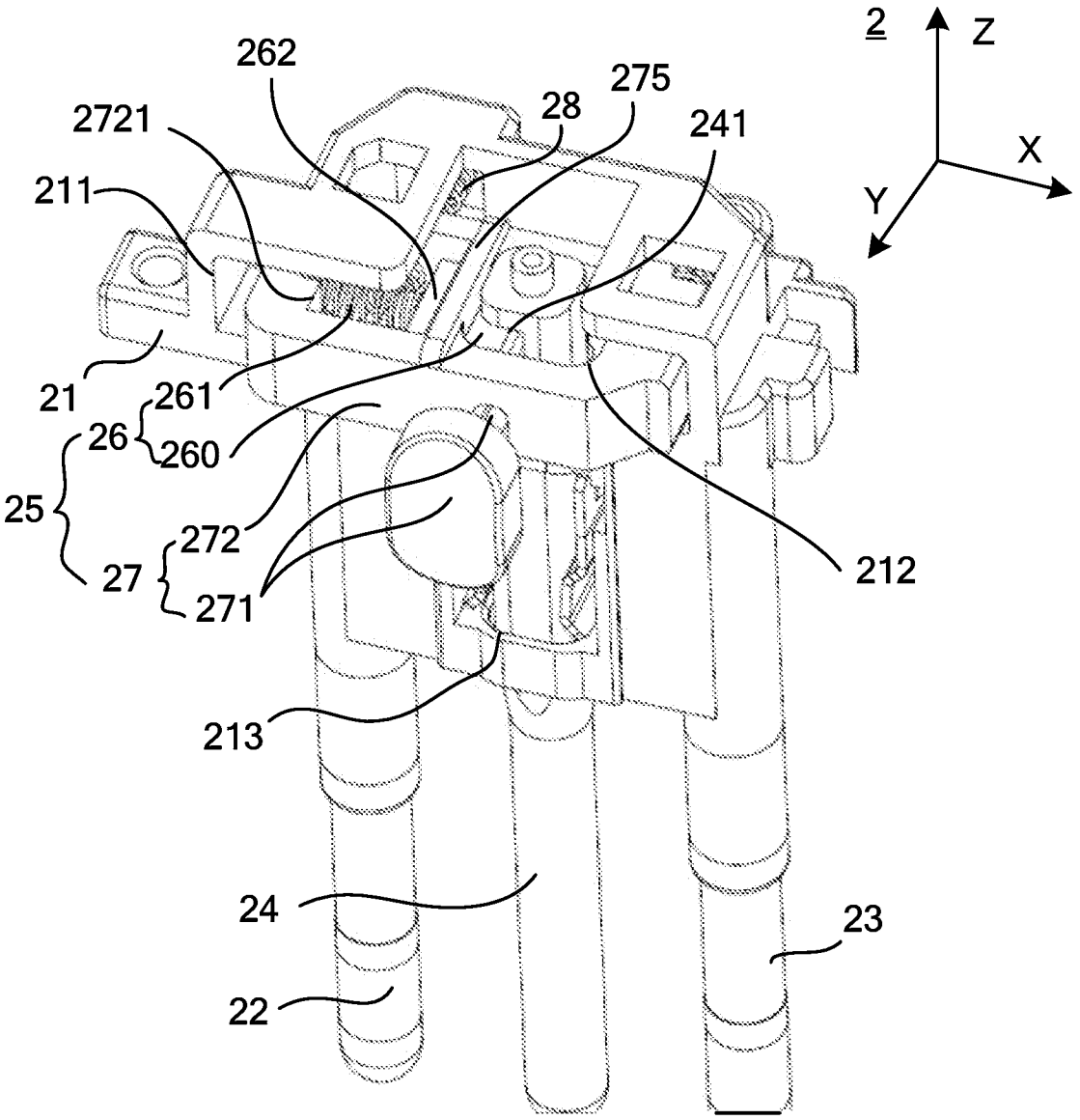
FIG. 3 is a perspective view showing a state of a three-pole plug pin assembly of a converter in accordance with some embodiments of the present disclosure.
Figure 4:
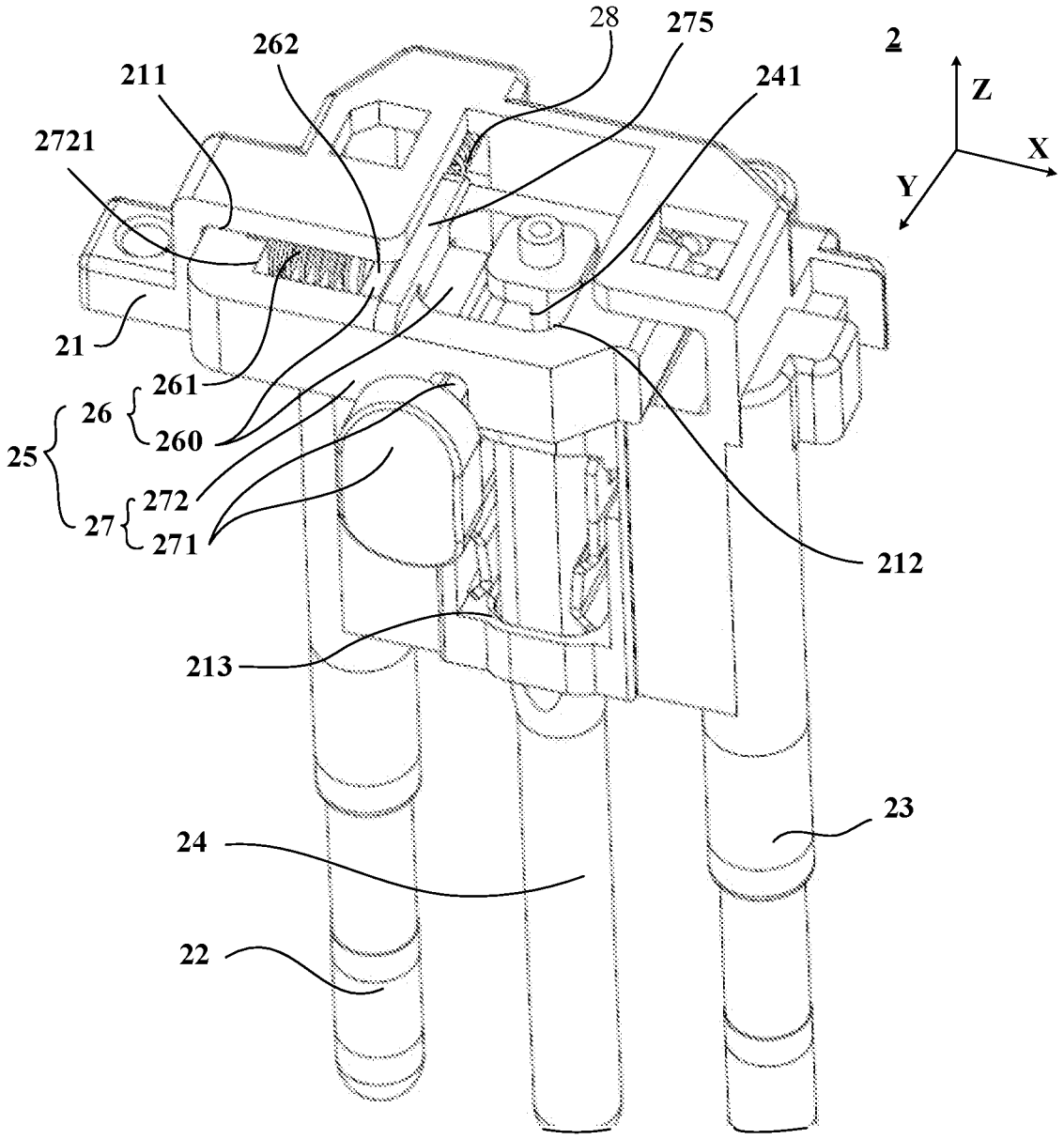
FIG. 4 is a perspective view showing another state of a three-pole plug pin assembly of a converter in accordance with some embodiments of the present disclosure.

In use, the lock pin 26 is located in the mounting hole 2721 of the toggle button 27, and the toggle button 27 is located in the cavity 211 of the body 21. It will be noted that, a dimension of the toggle button 27 in the X direction shown in FIG. 5 is less than a dimension of the cavity 211 in the X direction. In this way, the toggle button 27 is able to move in the X direction in the cavity 211, so that the toggle button assembly 25 is movably connected to the body 21. In this case, as shown in FIGS. 3 and 4, a portion of the mounting hole 2721 proximate to the hand-held portion 271 is opposite to the first through hole 212. The earth-pole plug pin 24 sequentially passes through the mounting hole 2721, the first through hole 212 and the second through hole 213 from top to bottom in the Z direction shown in FIG. 5. The first through hole 212 and the second through hole 213 are located at different heights in the Z direction shown in FIG. 5. On one hand, the earth-pole plug pin 24 is guided and limited to ensure that the earth-pole plug pin 24 passes through the first through hole 212 and the second through hole 213 and moves smoothly in the Z direction. On another hand, hole walls of the first through hole 212 and the second through hole 213 serve to support the earth-pole plug pin 24, so as to ensure a stress balance when the earth-pole plug pin 24 and the toggle button assembly 25 are clamped, and to better keep the earth-pole plug pin 24 in a stable state. The lock pin 26 includes a lock pin body 260 and a second elastic member 261. In a case where the lock pin 26 is mounted in the mounting hole 2721 of the toggle button 27, a first end of the second elastic member 261 is connected to an inner wall of the mounting hole 2721, and a second end of the second elastic member 261 is connected to the lock pin body 260. The second elastic member 261 may be a spring or an elastic sheet, which is not specifically limited herein.

In some embodiments, in order to prevent the lock pin body 260 from moving under an action of an elastic force of the second elastic member 261, so as to avoid interfering with surrounding components, as shown in FIG. 5, the lock pin 26 further includes a first limiting portion 262, and the first limiting portion 262 is located on an end of the lock pin body 260 proximate to the second elastic member 261. The toggle button 27 further includes the second limiting portion 275, and the second limiting portion 275 is approximately located in the middle of the mounting hole 2721 in the X direction shown in FIG. 5. In the case where the lock pin 26 is mounted in the mounting hole 2721 of the toggle button 27, the first limiting portion 262 is opposite to the second limiting portion 275, the first limiting portion 262 is located at a left side of the second limiting portion 275 in the X direction, and the second limiting portion 275 is located at a right side of the first limiting portion 262 in the X direction. The second limiting portion 275 may abut against the first limiting portion 262, so that a position of the lock pin body 260 relative to the toggle button 27 in the X direction is fixed. Therefore, a problem that the lock pin body 260 moves to other positions under the action of the elastic force of the second elastic member 261 and thus interferes with the surrounding components is avoided.

The lock pin body 260 and the second elastic member 261 are both located in a portion of the mounting hole 2721 away from the hand-held portion 271, and in this case, the second elastic member 261 is in a compressed state. Since the lock pin 26 is disposed in the mounting hole 2721, and the earth-pole plug pin 24 passes through the mounting hole 2721, in the case where the toggle button assembly 25 and the earth-pole plug pin 24 are clamped (e.g., when the lock pin body 260 extends into a clamping groove 241 described below), a hole wall of the mounting hole 2721 may serve to limit and support the lock pin body 260 and the earth-pole plug pin 24, which avoids the lock pin body 260 and the earth-pole plug pin 24 from shaking greatly, thereby enabling the toggle button assembly 25 and the earth-pole plug pin 24 to be clamped more firmly.

As shown in FIGS. 3 to 5, the earth-pole plug pin 24 includes the clamping groove 241 located in a side face thereof. After the earth-pole plug pin 24 is mounted in the mounting hole 2721 of the toggle button 27 and in the first through hole 212 and the second through hole 213 of the body 21, the lock pin body 260 is capable of extending into the clamping groove 241 under the driving of the toggle button 27, so that the toggle button assembly 25 is clamped with the earth-pole plug pin 24, and thus the toggle button assembly 25, the earth-pole plug pin 24 and the body 21 are connected together. The lock pin body 260 is also capable of disengaging from the clamping groove 241 under the driving of the toggle button 27, so as to separate the toggle button assembly 25 from the earth-pole plug pin 24. In a depth direction of the clamping groove 241 (in the X direction), a dimension m of the earth-pole plug pin 24 is less than a dimension n of the mounting hole 2721 (as shown in FIG. 5), so that the lock pin body 260 is able to move relative to the earth-pole plug pin 24 in the depth direction of the clamping groove 241.

Figure 6:
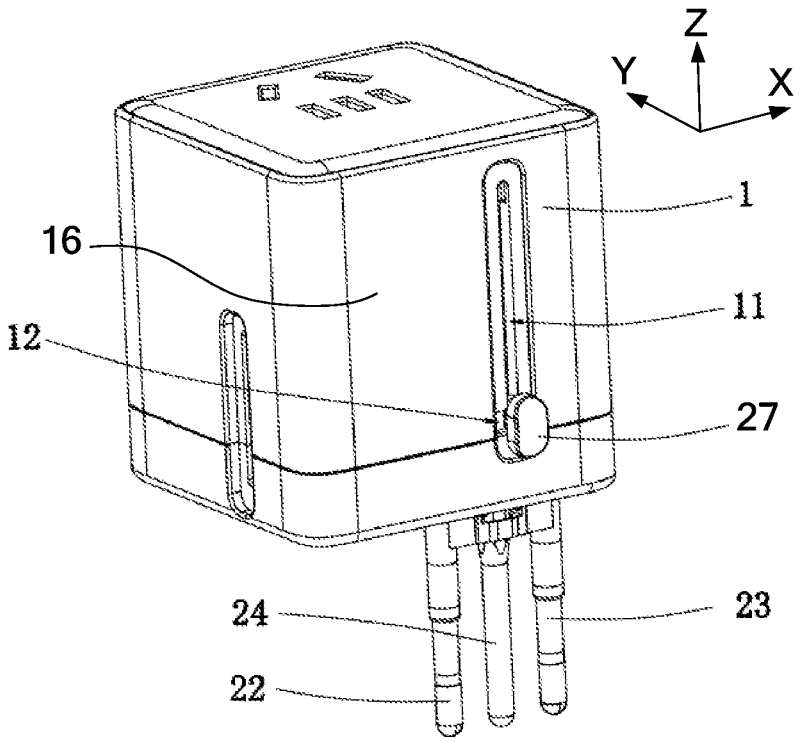
FIG. 6 is a state diagram of a converter used as a three-pole socket in accordance with some embodiments of the present disclosure.
Figure 7:
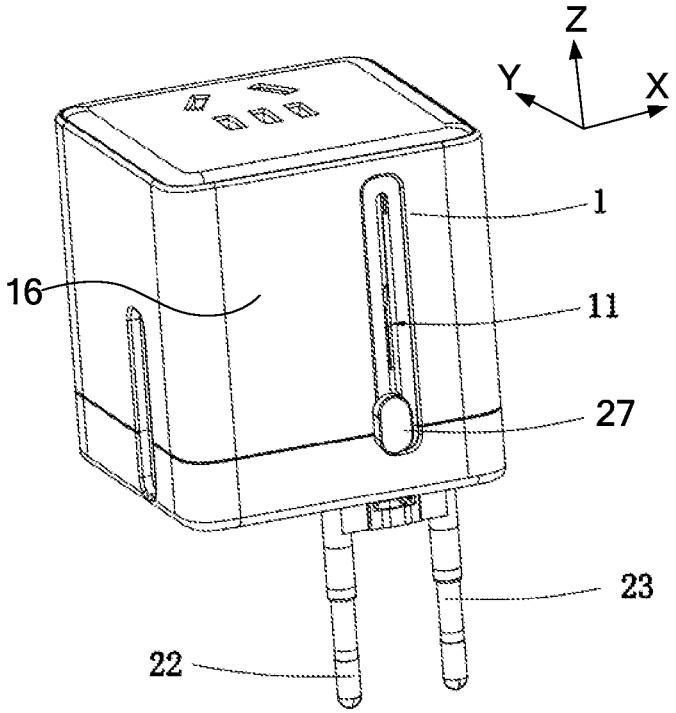
FIG. 7 is a state diagram of a converter used as a two-pole socket in accordance with some embodiments of the present disclosure.

Therefore, the toggle button assembly 25 is able to move relative to the body 21 between a first position (the position shown in FIG. 3, and in this case, the toggle button 27 and a left side wall of the cavity 211 have a gap therebetween, and the left side is a left side of the cavity 211 in the X direction shown in FIG. 3) and a second position (the position shown in FIG. 4, and in this case, the toggle button 27 and a right side wall of the cavity 211 have a gap therebetween, and the right side is a right side of the cavity 211 in the X direction shown in FIG. 4). As shown in FIGS. 3 and 6, when the toggle button assembly 25 is at the first position, the toggle button assembly 25 may be connected to the earth-pole plug pin 24. Then, the toggle button assembly 25 drives the body 21 and the earth-pole plug pin 24 to move synchronously relative to the housing 1 in a length direction of the earth-pole plug pin 24 (e.g., the Z direction in FIG. 3), so that the L-pole plug pin 22, the N-pole plug pin 23 and the earth-pole plug pin 24 extend out of the housing 1. As shown in FIGS. 4 and 7, when the toggle button assembly 25 is at the second position, the toggle button assembly 25 may be separated from the earth-pole plug pin 24, so that the earth-pole plug pin 24 is received in the housing 1.

As shown in FIG. 2, the three-pole plug pin assembly 2 further includes a first elastic member 29. The first elastic member 29 is connected between the earth-pole plug pin 24 and the housing 1. In a case where the first elastic member 29 is a spring, the spring is sleeved on the earth-pole plug pin 24, an end of the spring is connected to the earth-pole plug pin 24, and another end of the spring is connected to the housing 1. In this way, when the toggle button assembly 25 is at the first position, the earth-pole plug pin 24 extends out of the housing 1, and the first elastic member 29 is in a compressed state. When the toggle button assembly 25 is at the second position, the first elastic member 29 recovers from deformation, so that the earth-pole plug pin 24 is received in the housing 1.

In the converter in some embodiments of the present disclosure, by providing the toggle button assembly 25, in a case where the converter is used as a three-pole socket, the three-pole plug pin assembly 2 is a three-pole plug. As shown in FIG. 3, the toggle button assembly 25 is at the first position, and in this case, the toggle button assembly 25 is connected to the earth-pole plug pin 24. As shown in FIG. 6, the toggle button assembly 25 is toggled to move downwards in the Z direction, and the toggle button assembly 25 drives the body 21 to move downwards in the Z direction together with the L-pole plug pin 22, the N-pole plug pin 23 and the earth-pole plug pin 24, so that the L-pole plug pin 22, the N-pole plug pin 23 and the earth-pole plug pin 24 extend out of the housing 1 synchronously.

In a case where the converter is used as a two-pole socket, the three-pole plug pin assembly 2 is a two-pole plug. As shown in FIGS. 3 and 6, the toggle button assembly 25 is first toggled to enable the toggle button assembly 25 to locate at the first position (in this case, the hand-held portion 271 is closer to the right side in the X direction in FIG. 6), and the toggle button assembly 25 drives the body 21 to move downwards in the Z direction together with the L-pole plug pin 22, the N-pole plug pin 23 and the earth-pole plug pin 24 synchronously, and in this case, the L-pole plug pin 22, the N-pole plug pin 23 and the earth-pole plug pin 24 extend out relative to the housing 1. As shown in FIGS. 4 and 7, in this case, the toggle button assembly 25 is toggled again to enable the toggle button assembly 25 to move to the second position (in this case, the hand-held portion 271 is closer to the left side in the X direction in FIG. 7), so that the toggle button assembly 25 is separated from the earth-pole plug pin 24, and the earth-pole plug pin 24 is rebounded back into the housing 1 under an action of the first elastic member 29, thereby hiding the earth-pole plug pin 24 in the housing 1. In this case, only the L-pole plug pin 22 and the N-pole plug pin 23 extend out relative to the housing 1, and the three-pole plug pin assembly 2 may be the two-pole plug, which meets the requirement that the converter is used as the two-pole socket.

In some embodiments, the second elastic member 261 is configured to apply the elastic force to the lock pin body 260, which enables the lock pin body 260 to move towards the earth-pole plug pin 24. In this way, when the toggle button 27 drives the body 21 to retract the L-pole plug pin 22 and the N-pole plug pin 23 into the housing 1, the lock pin body 260 abuts against the side face of the earth-pole plug pin 24 under the action of the elastic force of the second elastic member 261. When the lock pin body 260 is opposite to the clamping groove 241, the lock pin body 260 automatically extends into the clamping groove 241 under the action of the elastic force of the second elastic member 261. Thus, the user does not need to manually toggle the toggle button 27 to enable the lock pin body 260 to re-extend into the clamping groove 241, thereby facilitating the operation of the user.

In the converter in some embodiments of the present disclosure, the toggle button assembly 25 may be connected to the earth-pole plug pin 24, and drive the L-pole plug pin 22, the N-pole plug pin 23 and the earth-pole plug pin 24 to synchronously extend and retract relative to the housing 1, so as to meet the requirement that the converter is used as the three-pole socket. The toggle button assembly 25 may also be separated from the earth-pole plug pin 24 to control the earth-pole plug pin 24 to be received in the housing 1, so as to meet the requirement that the converter is used as the two-pole socket. Therefore, by toggling the toggle button assembly 25, the converter may be switched rapidly to be used as the three-pole socket or the two-pole socket, and it is simple and convenient to operate and is convenient for the user to use the converter.

It will be noted that, when the toggle button assembly 25 is at the first position, a connection manner between the toggle button assembly 25 and the earth-pole plug pin 24 is not unique. In some embodiments, as shown in FIG. 3, the toggle button assembly 25 is configured to be clamped with the earth-pole plug pin 24, so as to connect to the earth-pole plug pin 24. By arranging the toggle button assembly 25 to be clamped with the earth-pole plug pin 24, it is ensured that the toggle button assembly 25 is firmly connected to the earth-pole plug pin 24, and when the toggle button assembly 25 is toggled, it is convenient to separate the toggle button assembly 25 from the earth-pole plug pin 24.

In some other embodiments, the toggle button assembly 25 may also be connected to the earth-pole plug pin 24 in a magnetic attraction manner. That is, the toggle button assembly 25 may be connected to the earth-pole plug pin 24 through a magnetic member (e.g., a magnet).

The toggle button assembly 25 is not unique in structure. In some embodiments, as shown in FIG. 5, the toggle button 27 is movably connected to the body 21 in the X direction in FIG. 5, so that the toggle button assembly 25 is able to move between the first position and the second position. The lock pin 26 is configured such that: as shown in FIG. 3, when the toggle button assembly 25 is at the first position, the lock pin body 260 extends into the clamping groove 241, so that the toggle button assembly 25 is clamped with the earth-pole plug pin 24; as shown in FIG. 4, when the toggle button assembly 25 is at the second position, the lock pin body 260 is separated from the clamping groove 241.

In some other embodiments, arrangement positions of the lock pin 26 and the clamping groove 241 may also be reversed. That is, the lock pin 26 is disposed on the side face of the earth-pole plug pin 24, and the clamping groove 241 is disposed on the toggle button 27. After the arrangement positions of the locking pin 26 and the clamping groove 241 are reversed, the connection and separation of the toggle button assembly 25 and the earth-pole plug pin 24 may also be realized.

In some embodiments, in order to make the toggle button 27 move more smoothly under the user's toggle, as shown in FIGS. 1, 6 and 7, the housing 1 includes a first sliding groove 11 and a second sliding groove 12 that are communicated with each other. The first sliding groove 11 extends in the length direction of the earth-pole plug pin 24, e.g., in the Z direction, and the second sliding groove 12 extends in a direction perpendicular to an extending direction of the first sliding groove 11 (e.g., in the X direction). When the three-pole plug pin assembly 2 is mounted in the housing 1, the hand-held portion 271 of the toggle button 27 extends out of the housing 1 through the first sliding groove 11 or the second sliding groove 12. The hand-held portion 271 is able to slide along the first sliding groove 11 and the second sliding groove 12. The second sliding groove 12 is configured such that: as shown in FIGS. 6 and 7, when the hand-held portion 271 slides along the second sliding groove 12, the toggle button assembly 25 may move relative to the body 21 between the first position (the position shown in FIG. 3) and the second position (the position shown in FIG. 4). The first sliding groove 11 serves to guide the hand-held portion 271 in a process that the user toggles the toggle button 27 to make the L-pole plug pin 22, the N-pole plug pin 23 and the earth-pole plug pin 24 extend out of the housing 1, thereby making the toggle button 27 move more smoothly. The second sliding groove 12 plays a guiding role when the user toggles the toggle button 27 to move relative to the body 21 between the first position and the second position, thereby making the toggle button 27 move more smoothly.

As shown in FIG. 1, the first sliding groove 11 has a first end 111 and a second end 112, and the second end 112 is located below the first end 111 in the Z direction in which the L-pole plug pin 22, the N-pole plug pin 23 and the earth-pole plug pin 24 extend out of the housing. As shown in FIG. 1, the second sliding groove 12 may be disposed at the second end 112 of the first sliding groove 11, or may also be disposed at a middle portion of the first sliding groove 11 (a portion of the first sliding groove 11 except for the first end 111 and the second end 112), which is not specifically limited herein.

Figure 8:
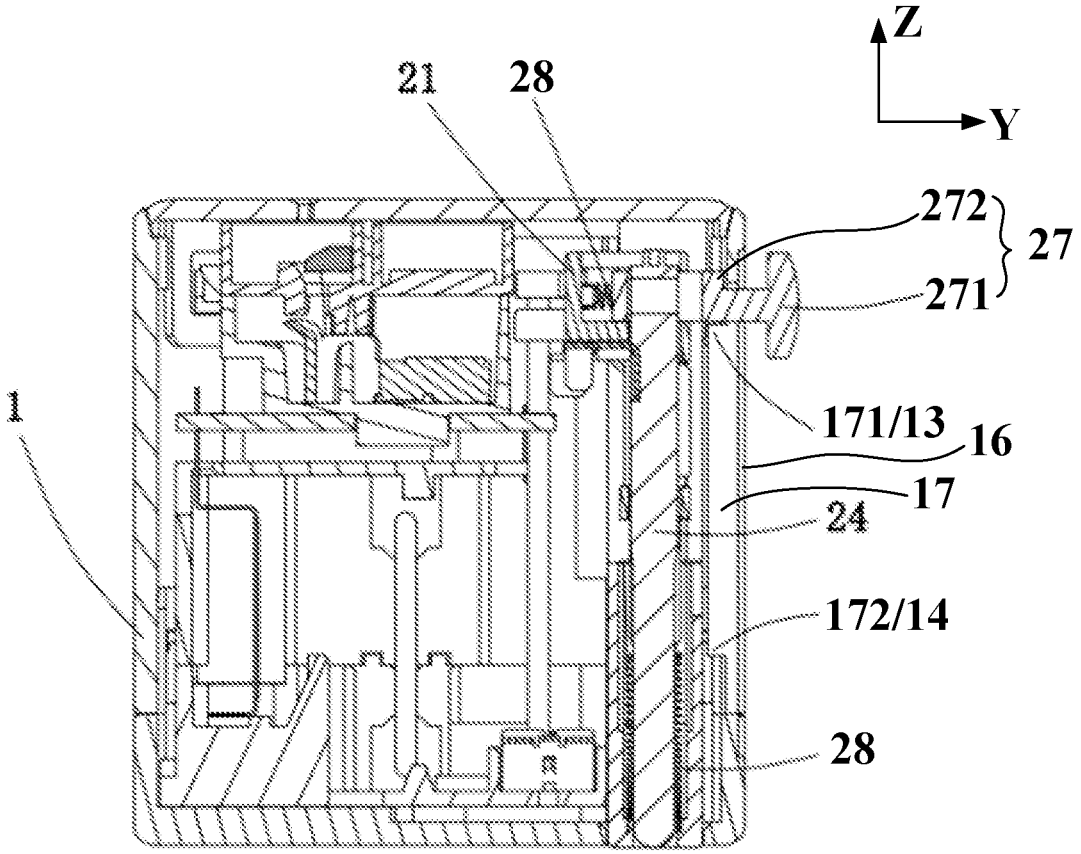
FIG. 8 is a cross-sectional structural diagram in a case where a three-pole plug pin assembly of a converter is received in a housing in accordance with some embodiments of the present disclosure.
Figure 9:
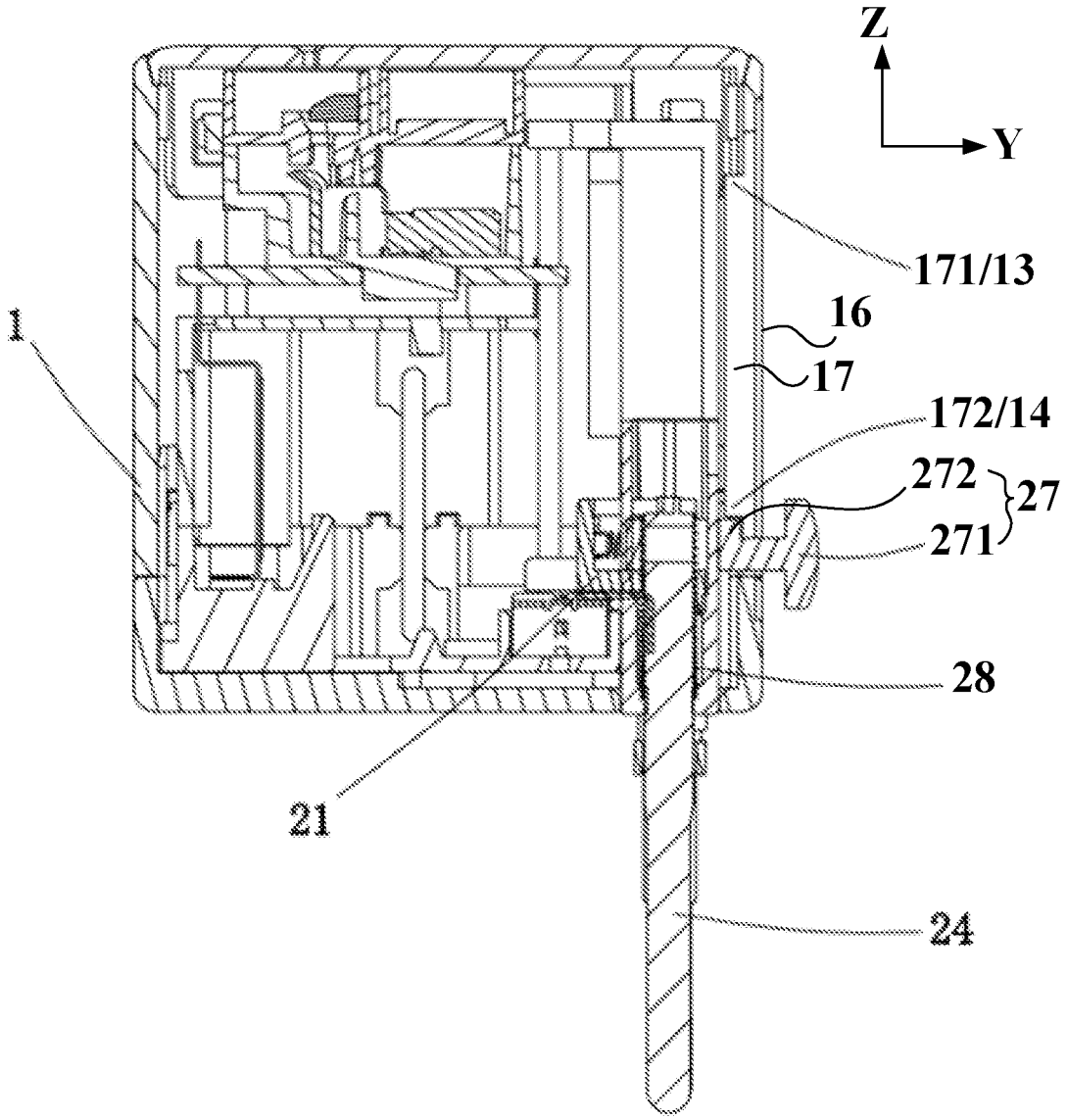
FIG. 9 is a cross-sectional structural diagram in a case where a three-pole plug pin assembly of a converter extends out of a housing in accordance with some embodiments of the present disclosure.

In some embodiments, as shown in FIG. 1, the housing 1 includes a bottom wall, a top wall, and four side walls between the bottom wall and the top wall. The top wall includes five receptacles that are configured to plug in a three-pole plug or a two-pole plug. As shown in FIGS. 8 and 9, the four side walls of the housing 1 include a first side wall 16. The first side wall 16 and the body 21 are arranged in the Y direction. The housing 1 includes a first blocking portion 13 and a second blocking portion 14 that are located on an inner surface of the first side wall 16, and the first blocking portion 13 and the second blocking portion 14 are spaced apart from each other in the Z direction.

As shown in FIGS. 8 and 9, the three-pole plug pin assembly 2 further includes a third elastic member 28. A first end of the third elastic member 28 is connected to the body 21, and a second end of the third elastic member 28 is connected to the bracket 272. The third elastic member 28 is configured to apply an elastic force to the bracket 272, which enables the bracket 272 to move towards the first side wall 16, so that the bracket 272 may abut against the first side wall 16.

The first blocking portion 13 is configured to be able to abut against a side surface of the bracket 272 proximate to the second blocking portion 14 (a lower surface in the orientation shown in FIG. 5) in a case where the L-pole plug pin 22, the N-pole plug pin 23 and the earth-pole plug pin 24 are received in the housing 1, so as to prevent the bracket 272 from moving towards the second blocking portion 14.

The second blocking portion 14 is configured to be able to abut against a side surface of the bracket 272 proximate to the first blocking portion 13 (an upper surface in the orientation shown in FIG. 5) in a case where the L-pole plug pin 22 and the N-pole plug pin 23 extend out of the housing 1, so as to prevent the bracket 272 from moving towards the first blocking portion 13.

In some embodiments, as shown in FIG. 8, in the case where the L-pole plug pin 22, the N-pole plug pin 23 and the earth-pole plug pin 24 are received in the housing 1, the bracket 272 abuts against the first blocking portion 13 under an acting force of the third elastic member 28, so as to prevent the bracket 272 from moving towards the second blocking portion 14. In this case, if the hand-held portion 271 is not pressed in the Y direction to disengage the bracket 272 from the first blocking portion 13, the toggle button 27 cannot move along the first sliding groove 11 in the housing 1, and thus the L-pole plug pin 22, the N-pole plug pin 23 and the earth-pole plug pin 24 cannot extend out relative to the housing 1, which effectively prevents the L-pole plug pin 22, the N-pole plug pin 23 and the earth-pole plug pin 24 from extending out due to mistakenly toggling the toggle button 27.

As shown in FIG. 9, in the case where the L-pole plug pin 22 and the N-pole plug pin 23 extend out of the housing 1, the bracket 272 abuts against the second blocking portion 14 under the acting force of the third elastic member 28, so as to prevent the bracket 272 from moving towards the first blocking portion 13. In this case, if the hand-held portion 271 is not pressed in the Y direction to disengage the bracket 272 from the second blocking portion 14, the toggle button 27 cannot move along the first sliding groove 11 in the housing 1, and thus the L-pole plug pin 22 and the N-pole plug pin 23 cannot be received in the housing 1, which effectively prevents the L-pole plug pin 22 and the N-pole plug pin 23 from retracting into the housing 1 due to mistakenly toggling the toggle button 27.

The first blocking portion 13 and the second blocking portion 14 are not unique in structure. In some embodiments, as shown in FIGS. 8 and 9, the housing 1 further includes a boss 17 located on the inner surface of the first side wall 16. In the Z direction in which the L-pole plug pin 22 and the N-pole plug pin 23 extend out of the housing 1, the boss 17 has a first end face 171 and a second end face 172, and the second end face 172 is located below the first end face 171. The first end face 171 forms the first blocking portion 13, and the second end face 172 forms the second blocking portion 14. In some other embodiments, both the first blocking portion 13 and the second blocking portion 14 may be blocking ribs. The first blocking portion 13 and the second blocking portion 14 are set as the two end faces of the boss 17, which may increase strengths of the first blocking portion 13 and the second blocking portion 14, thereby improving a blocking effect of the first blocking portion 13 and the second blocking portion 14 on the toggle button 27.

As shown in FIG. 9, in the case where the L-pole plug pin 22, the N-pole plug pin 23 and the earth-pole plug pin 24 extend out of the housing 1 synchronously, the toggle button 27 is simultaneously subject to the action of the first elastic member 29 and the third elastic member 28. If the user releases the hand-held portion 271 prematurely, the L-pole plug pin 22, the N-pole plug pin 23 and the earth-pole plug pin 24 may easily retract into the housing 1 under the action of the first elastic member 29 before the bracket 272 abuts against the second blocking portion 14. In order to solve this problem, an elastic coefficient of the third elastic member 28 is greater than an elastic coefficient of the first elastic member 29. In this way, when the L-pole plug pin 22, the N-pole plug pin 23 and the earth-pole plug pin 24 extend out of the housing 1 synchronously, and the user releases the hand-held portion 271, a speed at which the third elastic member 28 recovers from deformation is greater than a speed at which the first elastic member 29 recovers from deformation. Thus, a speed at which the bracket 272 moves under the action of the third elastic member 28 is greater than a speed at which the bracket 272 moves under the action of the first elastic member 29. In this way, the bracket 272 may rapidly abut against the second blocking portion 14 under an action of an elastic force of the third elastic member 28, so as to prevent the L-pole plug pin 22, the N-pole plug pin 23 and the earth-pole plug pin 24 from retracting into the housing 1 under an action of an elastic force of the first elastic member 29.

The first elastic member 29 may be a spring or an elastic sheet, which is not specifically limited herein. The third elastic member 28 may be a spring or an elastic sheet, which is not specifically limited herein either.

In the description of the above embodiments, specific features, structures, materials or characteristics may be combined in any suitable manner in any one or more embodiments or examples.

The above descriptions are merely specific implementation manners of the present disclosure, but the protection scope of the present disclosure is not limited thereto. Changes or replacements that any person skilled in the art could readily conceive of within the technical scope of the present disclosure shall be included in the protection scope of the present disclosure. Therefore, the scope of the present disclosure shall be subject to the protection scope of the claims.

What is claimed is:

1. A converter, comprising:

a housing; and a three-pole plug pin assembly;

the three-pole plug pin assembly comprising:

a body disposed in the housing, the body being configured to be able to move relative to the housing, and the body including a cavity and a through hole communicated with the cavity;

an L-pole plug pin and an N-pole plug pin that are fixed on the body, the body being capable of driving the L-pole plug pin and the N-pole plug pin to extend out of or retract into the housing when moving relative to the housing;

an earth-pole plug pin separated from the body, the earth-pole plug pin passing through the through hole of the body;

a first elastic member connected to the earth-pole plug pin and disposed in the housing; and a toggle button assembly connected to the body, the toggle button assembly being located in the cavity of the body, and the toggle button assembly being configured to be able to move relative to the body between a first position and a second position in the cavity, wherein when the toggle button assembly is at the first position, the toggle button assembly is connected to the earth-pole plug pin, so that the toggle button assembly is capable of driving the earth-pole plug pin, the L-pole plug pin and the N-pole plug pin to extend out of the housing; and when the toggle button assembly is at the second position, the toggle button assembly is separated from the earth-pole plug pin, so that the earth-pole plug pin is received in the housing under an action of the first elastic member.

2. The converter according to claim 1, wherein the toggle button assembly is configured to be clamped with the earth-pole plug pin at the first position, so as to be connected to the earth-pole plug pin.

3. The converter according to claim 2, wherein the toggle button assembly includes a toggle button and a lock pin;

the toggle button includes a bracket and a mounting hole located in the bracket, the mounting hole is communicated with the through hole of the body, and the lock pin is located in the mounting hole, and the earth-pole plug pin passes through the mounting hole;

the earth-pole plug pin includes a clamping groove located in a side face of the earth-pole plug pin; and the lock pin is configured such that: when the toggle button assembly is at the first position, the lock pin extends into the clamping groove, so that the toggle button assembly is clamped with the earth-pole plug pin; and when the toggle button assembly is at the second position, the lock pin is separated from the clamping groove.

4. The converter according to claim 3, wherein the lock pin includes a lock pin body and a second elastic member, a first end of the second elastic member is connected to an inner wall of the bracket, and a second end of the second elastic member is connected to the lock pin body, and the second elastic member is configured to apply an elastic force to the lock pin body, which enables the lock pin body to move towards the earth-pole plug pin.

5. The converter according to claim 4, wherein the lock pin further includes a first limiting portion, and the first limiting portion is located on an end of the lock pin body proximate to the second elastic member;

the toggle button further includes a second limiting portion, and the second limiting portion is located at a side of the first limiting portion proximate to the earth-pole plug pin; and the second limiting portion is capable of abutting against the first limiting portion, so as to prevent the lock pin body from moving towards the earth-pole plug pin.

6. The converter according to claim 4, wherein in a depth direction of the clamping groove, a dimension of the earth-pole plug pin is less than a dimension of the mounting hole, so that the lock pin body is capable of moving relative to the earth-pole plug pin.

7. The converter according to claim 4, wherein the housing includes a first sliding groove and a second sliding groove that are communicated with each other, the first sliding groove extends in a direction in which the earth-pole plug pin extends out of the housing, and the second sliding groove extends in a direction perpendicular to an extending direction of the first sliding groove;

the toggle button further includes a hand-held portion, and the hand-held portion is fixedly connected to the bracket;

wherein the hand-held portion extends out of the housing, and the hand-held portion is capable of sliding along both the first sliding groove and the second sliding groove; and the second sliding groove is configured such that: when the hand-held portion slides along the second sliding groove, the toggle button assembly moves relative to the body between the first position and the second position.

8. The converter according to claim 4, wherein the housing has a first side wall, and the first side wall is arranged opposite to the body;

the housing includes a first blocking portion and a second blocking portion that are located on an inner surface of the first side wall, and the first blocking portion is spaced apart from the second blocking portion in a direction in which the earth-pole plug pin extends out of the housing;

the first blocking portion is configured to be able to abut against a side surface of the bracket proximate to the second blocking portion in a case where the L-pole plug pin, the N-pole plug pin and the earth-pole plug pin are received in the housing, so as to prevent the bracket from moving towards the second blocking portion; and the second blocking portion is configured to be able to abut against a side surface of the bracket proximate to the first blocking portion in a case where the L-pole plug pin and the N-pole plug pin extend out of the housing, so as to prevent the bracket from moving towards the first blocking portion.

9. The converter according to claim 8, wherein the housing includes a boss located on the inner surface of the first side wall, and the boss has a first end face and a second end face in the direction in which the earth-pole plug pin extends out of the housing; and the first end face forms the first blocking portion, and the second end face forms the second blocking portion.

10. The converter according to claim 4, wherein the housing has a first side wall, and the first side wall is arranged opposite to the body; and the three-pole plug pin assembly further includes a third elastic member, a first end of the third elastic member is connected to an inner wall of the body, and a second end of the third elastic member is connected to the bracket, and the third elastic member is configured to apply an elastic force to the bracket, which enables the bracket to move towards the first side wall, so that the bracket is able to abut against the first side wall.

11. The converter according to claim 10, wherein an elastic coefficient of the third elastic member is greater than an elastic coefficient of the first elastic member.

12. The converter according to claim 1, wherein the through hole of the body includes a first through hole and a second through hole, and the first through hole is spaced apart from the second through hole in a direction in which the earth-pole plug pin extends out of the housing.

13. The converter according to claim 5, wherein the housing includes a first sliding groove and a second sliding groove that are communicated with each other, the first sliding groove extends in a direction in which the earth-pole plug pin extends out of the housing, and the second sliding groove extends in a direction perpendicular to an extending direction of the first sliding groove;

the toggle button further includes a hand-held portion, and the hand-held portion is fixedly connected to the bracket;

wherein the hand-held portion extends out of the housing, and the hand-held portion is able to slide along both the first sliding groove and the second sliding groove; and the second sliding groove is configured such that: when the hand-held portion slides along the second sliding groove, the toggle button assembly moves relative to the body between the first position and the second position.

14. The converter according to claim 5, wherein the housing has a first side wall, and the first side wall is arranged opposite to the body;

the housing includes a first blocking portion and a second blocking portion that are located on an inner surface of the first side wall, and the first blocking portion is spaced apart from the second blocking portion in a direction in which the earth-pole plug pin extends out of the housing;

the first blocking portion is configured to be able to abut against a side surface of the bracket proximate to the second blocking portion in a case where the L-pole plug pin, the N-pole plug pin and the earth-pole plug pin are received in the housing, so as to prevent the bracket from moving towards the second blocking portion; and the second blocking portion is configured to be able to abut against a side surface of the bracket proximate to the first blocking portion in a case where the L-pole plug pin and the N-pole plug pin extend out of the housing, so as to prevent the bracket from moving towards the first blocking portion.

15. The converter according to claim 7, wherein the housing has a first side wall, and the first side wall is arranged opposite to the body;

the housing includes a first blocking portion and a second blocking portion that are located on an inner surface of the first side wall, and the first blocking portion is spaced apart from the second blocking portion in a direction in which the earth-pole plug pin extends out of the housing;

the first blocking portion is configured to be able to abut against a side surface of the bracket proximate to the second blocking portion in a case where the L-pole plug pin, the N-pole plug pin and the earth-pole plug pin are received in the housing, so as to prevent the bracket from moving towards the second blocking portion; and the second blocking portion is configured to be able to abut against a side surface of the bracket proximate to the first blocking portion in a case where the L-pole plug pin and the N-pole plug pin extend out of the housing, so as to prevent the bracket from moving towards the first blocking portion.

16. The converter according to claim 5, wherein the housing has a first side wall, and the first side wall is arranged opposite to the body; and the three-pole plug pin assembly further includes a third elastic member, a first end of the third elastic member is connected to an inner wall of the body, and a second end of the third elastic member is connected to the bracket, and the third elastic member is configured to apply an elastic force to the bracket, which enables the bracket to move towards the first side wall, so that the bracket is able to abut against the first side wall.

17. The converter according to claim 7, wherein the housing has a first side wall, and the first side wall is arranged opposite to the body; and the three-pole plug pin assembly further includes a third elastic member, a first end of the third elastic member is connected to an inner wall of the body, and a second end of the third elastic member is connected to the bracket, and the third elastic member is configured to apply an elastic force to the bracket, which enables the bracket to move towards the first side wall, so that the bracket is able to abut against the first side wall.

18. The converter according to claim 8, wherein the housing has a first side wall, and the first side wall is arranged opposite to the body; and the three-pole plug pin assembly further includes a third elastic member, a first end of the third elastic member is connected to an inner wall of the body, and a second end of the third elastic member is connected to the bracket, and the third elastic member is configured to apply an elastic force to the bracket, which enables the bracket to move towards the first side wall, so that the bracket is able to abut against the first side wall.

* * * * *